US005807188A

United States Patent [19]

Serrano et al.

[11] Patent Number: 5,807,188

[45] Date of Patent: Sep. 15, 1998

[54] WOOD TYPE GOLF CLUB HEAD

[75] Inventors: Anthony D. Serrano; John A. Solheim, both of Phoenix, Ariz.

[73] Assignee: Karsten Manufacturing Corporation, Phoenix, Ariz.

[21] Appl. No.: 771,083

[22] Filed: Dec. 20, 1996

[51] Int. Cl.[6] ..... A63B 53/04

[52] U.S. Cl. ..... 473/338; 473/349

[58] Field of Search ..... 473/335, 338, 473/324, 349

[56] References Cited

U.S. PATENT DOCUMENTS

| | | | |
|---|---|---|---|
| D. 246,734 | 12/1977 | Morita . | |
| D. 253,778 | 12/1979 | Madison . | |
| 1,574,213 | 2/1926 | Tyler . | |
| 2,163,091 | 6/1939 | Held | 473/338 |
| 2,756,055 | 7/1956 | Bittner . | |
| 3,064,980 | 11/1962 | Steiner | 473/338 |
| 3,466,047 | 9/1969 | Rodia | 473/338 |
| 3,556,533 | 1/1971 | Hollis | 473/338 |
| 3,582,081 | 6/1971 | Caplan | 473/338 |
| 3,606,327 | 9/1971 | Gorman | 473/337 |
| 3,692,306 | 9/1972 | Glover | 473/338 |
| 4,043,563 | 8/1977 | Churchward . | |
| 4,795,159 | 1/1989 | Nagamoto | 473/338 |
| 5,251,901 | 10/1993 | Solheim . | |

*Primary Examiner*—Sebastiano Passaniti
*Attorney, Agent, or Firm*—Darrell F. Marquette

[57] ABSTRACT

A wood type golf club head includes a body having a face for impacting a golf ball, a top, a bottom, a toe end and a heel end. A sole plate made of high density material is attached to and substantially covers the bottom of the body. An insert made of low density material is disposed in an opening in a center section of the sole plate and extends into a cavity formed in the bottom of the body. By utilizing high density material for the sole plate in combination with low density material for the insert, a significant amount of weight is removed from the center of the club head which maximizes the perimeter weighting of the club head while increasing the moments of inertia of the club head. Preferably, the sole plate is made of a suitable metal such as brass, copper, bronze or nickel, and the insert is made of a suitable plastic.

7 Claims, 2 Drawing Sheets

WOOD TYPE GOLF CLUB HEAD

BACKGROUND OF THE INVENTION

This invention relates generally to golf clubs and, in particular, to a type of golf club commonly referred to as a "wood".

U.S. Pat. No. 5,251,901 to John A. Solheim and Anthony D. Serrano discloses a wood type golf club including a head having a sole plate with a cavity in a center section of the sole plate. The purpose of this cavity is to remove weight from the sole plate center section and relocate the removed weight to perimeter sections of the sole plate to increase the perimeter weighting of the club head. The advantage of increased perimeter weighting is increased resistance to twisting movements caused by increased moments of inertia. A drawback of the club head disclosed in the Solheim et al patent is that there is a practical limit to the amount of weight that may be removed from the sole plate center section without adversely affecting the structural integrity of the sole plate. Therefore, the maximum degree of perimeter weighting may not be achieved.

SUMMARY OF THE INVENTION

The present invention provides a wood type golf club head including a body having a face for impacting a golf ball, a top, a bottom, a toe end, a heel end, and a socket formed in the heel end for receiving one end of an elongated shaft. A sole plate is attached to and substantially covers the bottom of the body. The sole plate is formed of high density material and has an opening in a center section thereof. An insert formed of low density material is disposed in the sole plate opening. In the preferred embodiment of the club head, the high density material of the sole plate has a density in a range between 0.28 and 0.35 pounds per cubic inch. The low density material of the insert has a density in a range between 0.035 and 0.060 pounds per cubic inch. The sole plate is preferably made of metal such as brass, copper, bronze or nickel; and the insert is preferably made of plastic.

DESCRIPTION OF THE PREFERRED EMBODIMENT

Figure 1:
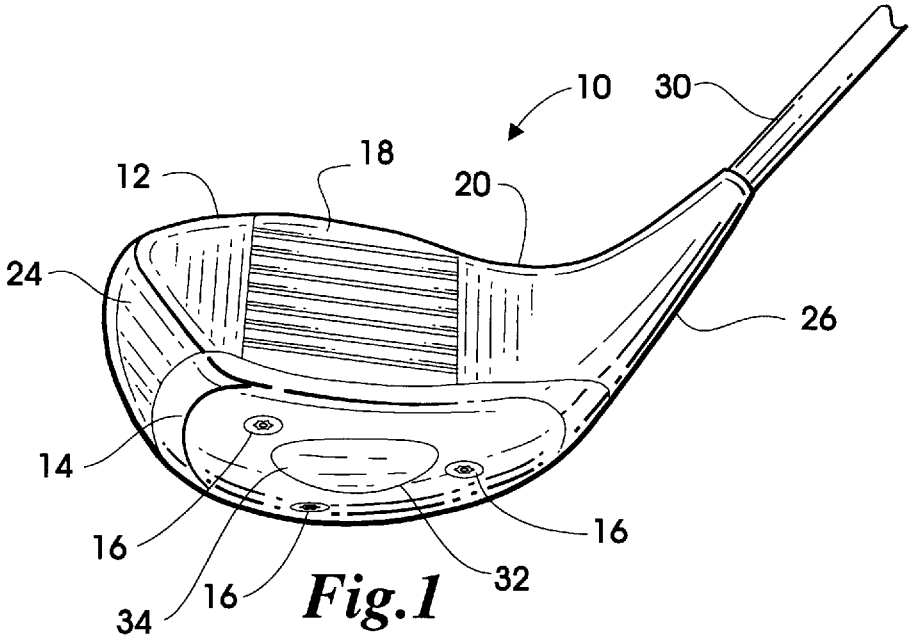
FIG. 1 is a bottom perspective view of a golf club head according to the preferred embodiment of the present invention.
Figure 2:
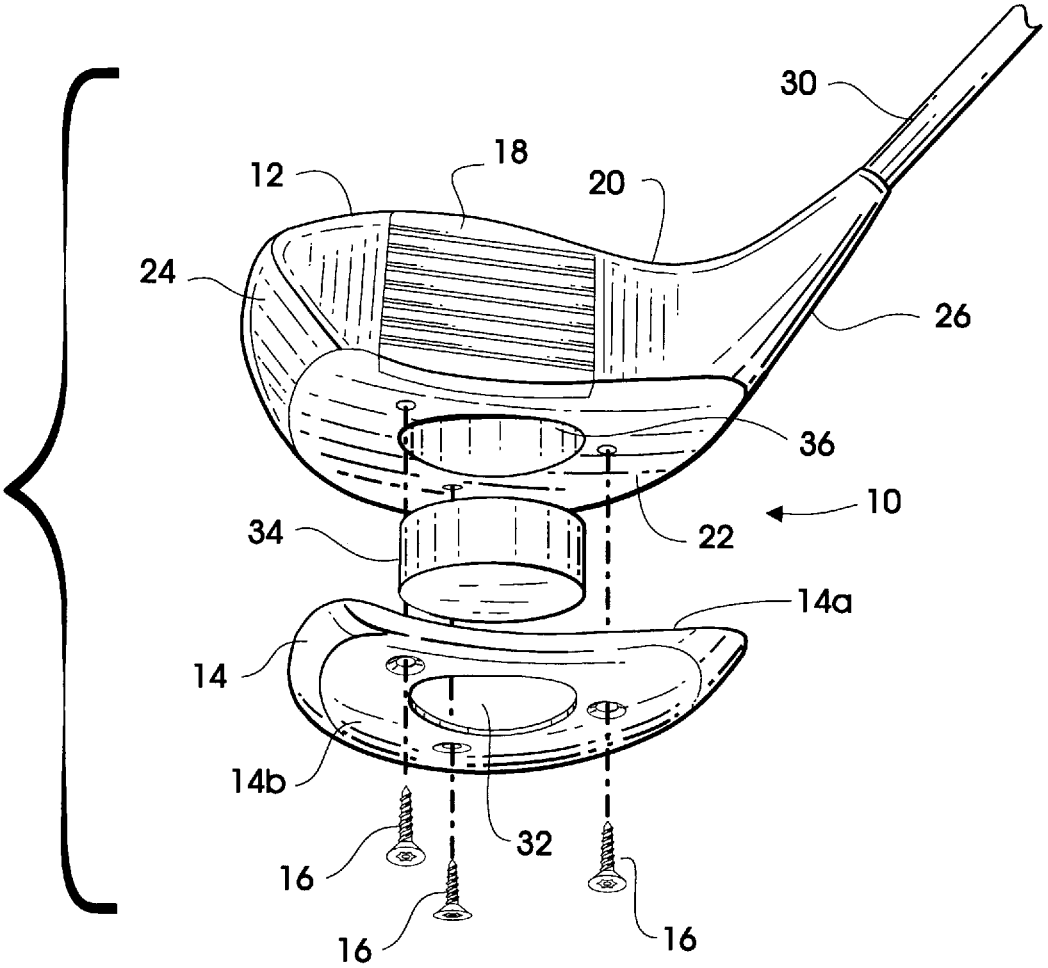
FIG. 2 is an exploded perspective view of the golf club head shown in FIG. 1.
Figure 3:
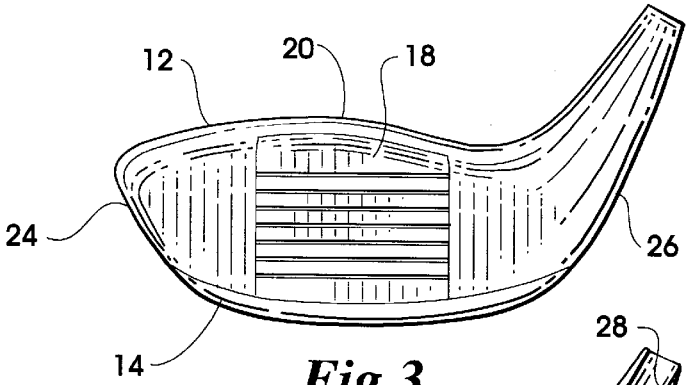
FIG. 3 is a front elevational view of the golf club head shown in FIG. 1.
Figure 4:
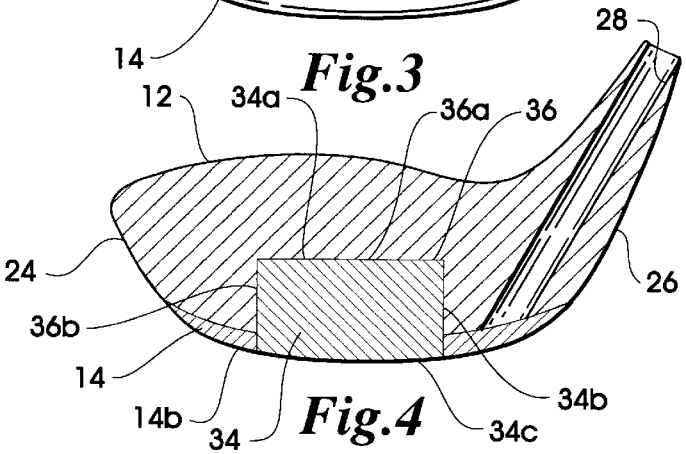
FIG. 4 is a vertical cross-sectional view of the golf club head of FIG. 1.

Referring to FIGS. 1 and 2, a wood type golf club head 10 according to the preferred embodiment of the present invention includes a body 12 and a sole plate 14 attached to the body 12 by a plurality fasteners 16 such as screws. The body 12 is preferably made of wood, and the sole plate 14 is preferably made of metal. The body 12 has a face 18 arranged for impacting a golf ball, a top 20, a bottom 22, a toe end 24 and a heel end 26. The sole plate 14 has inner and outer surfaces 14*a*, 14*b*. The sole plate outer surface 14*b* has a compound curvature, i.e. one curvature extending between the body toe and heel ends 24, 26 and another curvature extending rearward from the face 18 of the body 12. A socket 28, seen in FIG. 4, is provided in the body heel end 26 for receiving one end of an elongated shaft 30.

Figure 5:
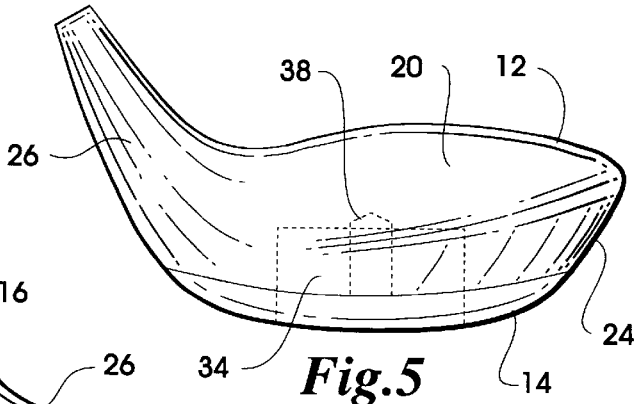
FIG. 5 is a rear elevational view of the golf club head shown in FIG. 1.
Figure 7:
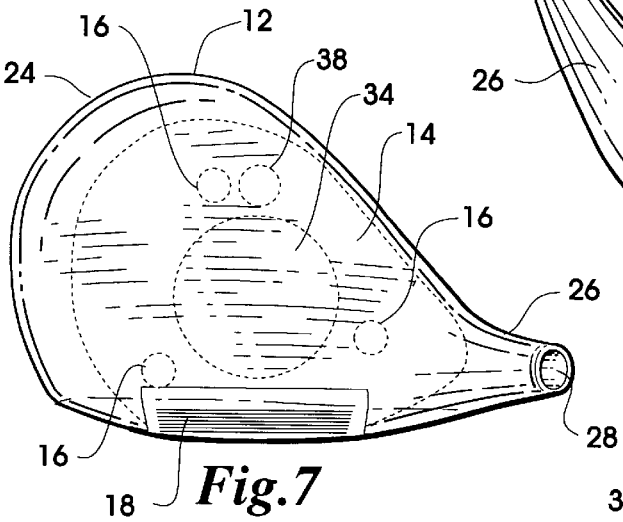
FIG. 7 is a top plan view of the golf club head of FIG. 1.

The sole plate 14 substantially covers the bottom 22 of the body 12 and is formed of high density material such as metal. Suitable metals which may be used in forming the sole plate 14 include brass, copper, bronze and nickel. A generally circular opening or hole 32 is provided in a center section of the sole plate 14, and a generally cylindrical insert 34 is disposed in the opening 32. The insert 34 is preferably formed of low density material such as plastic. The body 12 has a generally cylindrical cavity 36 in the bottom 22, and the insert 34 extends upwardly into the cavity 36. The cavity 36 has a planar top wall 36*a* and a cylindrical side wall 36*b* as seen in FIG. 4. The insert 34 has a planar upper surface 34*a* that corresponds with the cavity top wall 36*a*, a cylindrical side surface 34*b* that corresponds with the cavity side wall 36*b*, and a curved lower surface 34*c* that corresponds with the outer surface 14*b* of the sole plate 14. A weight 38 shown in FIGS. 5–7 and preferably made of lead is disposed in a bore in the bottom 22 of the body 12.

In the preferred embodiment of the present invention, the high density material of the sole plate 14 is in a range between 0.28 and 0.35 pounds per cubic inch. The low density material of the insert 34 is in a range between 0.035 and 0.060 pounds per cubic inch. By utilizing high density material for the sole plate 14 and low density material for the insert 34, a significant amount of weight is removed from the center of the club head 10 which maximizes the perimeter weighting of the club head 10 while increasing the moments of inertia of the club head 10. Also, the center of gravity of the club head 10 is moved downward and rearward by the weight 38 and by the use of high and low density materials in the sole plate 14 and the insert 34, respectively.

According to one embodiment of the club head 10, the sole plate 12 is made of brass and the insert 34 is made of a plastic material sold under the trade name ISOPLAST and manufactured by Dow Chemical Company. After the sole plate 14 is attached to the body 12 by the screws 16, the insert 34 (which is a solid cylindrical piece of ISOPLAST material) is inserted into the body cavity 36 via the opening 32 in the sole plate 14. The insert 34 is secured to both the body 12 and the sole plate 14 by applying an adhesive such as epoxy to the insert side surface 34*b* before inserting the insert 34 into the cavity 36. Alternatively, liquid urethane is poured into the body cavity 34 through the opening 32 in the sole plate 14 filling the body cavity 36 and the sole plate opening 32. When the liquid urethane is allowed to dry, it hardens and forms the insert 34. This alternative method of making the club head 10 results in the insert 34 being tightly bonded to both the body 12 and the sole plate 14 without the use of an adhesive.

Figure 6:
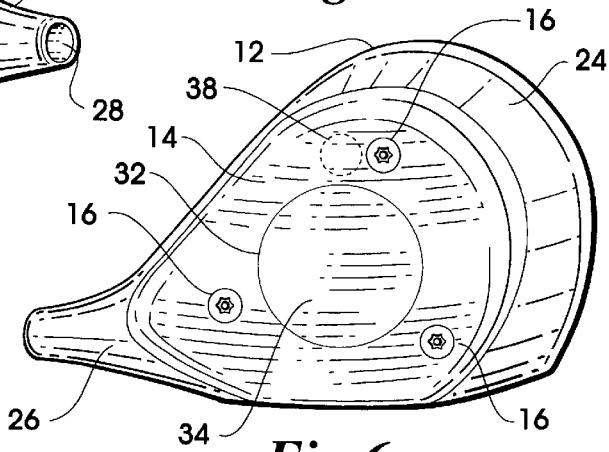
FIG. 6 is a bottom plan view of the golf club head of FIG. 1.

It will be understood that the insert 34 may be transparent so that indicia (not shown) placed against the top wall 36a of the body cavity 36 is visible when the club head 10 is viewed as in FIG. 6.

Another advantage of utilizing low density material for the insert 34 is that it allows the insert 34 to absorb vibration which may result when the club head 10 impacts a golf ball on the face 18 of the body 12.

The present invention provides a wood type golf club head with maximized perimeter weighting, increased moments of inertia, and a low center of gravity. These features are especially important in fairway woods, i.e. woods usually designated by numbers such as 3, 5 and 7, because fairway woods are used to strike a golf ball that is resting directly on the ground instead of sitting on a tee above the ground.

What is claimed is:

1. A wood type golf club head comprising:

a body having a face for impacting a golf ball, a top, a bottom, a toe end, a heel end, and a socket formed in said heel end for receiving one end of an elongated shaft;

said body having a cavity formed in said bottom which removes a substantial amount of weight from a central portion of said body;

a sole plate attached to and substantially covering the bottom of said body, said sole plate being formed of a first material having a first density, said sole plate having an opening in a center section thereof aligned with said body cavity;

fastener means for attaching said sole plate to said body; and an insert disposed in said sole plate opening and extending upwardly into said body cavity, said insert replacing said substantial amount of weight removed from said central portion of said body by said cavity and being formed of a second material having a second density, said second density being substantially lower than said first density whereby the club head has increased perimeter weighting.

2. The wood type golf club head of claim 1, wherein said first density is in a range between 0.28 and 0.35 pounds per cubic inch.

3. The wood type golf club head of claim 2, wherein said first material is metal.

4. The wood type golf club head of claim 3, wherein said second density is in a range between 0.035 and 0.060 pounds per cubic inch.

5. The wood type golf club head of claim 4, wherein said second material is plastic.

6. The wood type golf club head of claim 1, wherein said fastener means comprises screws.

7. A method of making a wood type golf club head comprising the steps of:

providing a body having a face for impacting a golf ball, a top, a bottom, a toe end, and a heel end;

providing said body with a cavity in the bottom thereof which removes a substantial amount of weight from a central portion of said body;

attaching a sole plate made of high density material to said body by using fastener means so that said sole plate substantially covers the bottom of said body;

providing said sole plate with an opening in a center section thereof aligned with said body cavity; and inserting low density material through said sole plate opening into said body cavity to form an insert that replaces said substantial amount of weight removed from said central portion of said body by said cavity so that the club head has increased perimeter weighting.

* * * * *